US006682265B1

(12) United States Patent
Kudsk

(10) Patent No.: US 6,682,265 B1
(45) Date of Patent: Jan. 27, 2004

(54) METHOD OF ESTABLISHING AND/OR OPERATING A BORE WELL IN A SEABED AND A DRILLING VESSEL FOR USE IN CONNECTION THEREWITH

(75) Inventor: Gregers Kudsk, Copenhagen (DK)

(73) Assignee: A.P. Moller-Maersk A/S, Copenhagen (DK)

( * ) Notice: Subject to any disclaimer, the term of this patent is extended or adjusted under 35 U.S.C. 154(b) by 0 days.

(21) Appl. No.: 09/979,992

(22) PCT Filed: May 26, 2000

(86) PCT No.: PCT/DK00/00283

§ 371 (c)(1),
(2), (4) Date: Feb. 25, 2002

(87) PCT Pub. No.: WO00/73135

PCT Pub. Date: Dec. 7, 2000

(30) Foreign Application Priority Data

May 27, 1999 (DK) ..... 1999 00748
Jun. 17, 1999 (DK) ..... 1999 00860

(51) Int. Cl.[7] ..... E02D 25/00
(52) U.S. Cl. ..... 405/209; 114/260; 114/265
(58) Field of Search ..... 405/203, 204, 405/205, 206, 209; 114/125, 258, 259, 260, 263, 264, 265, 266

(56) References Cited

U.S. PATENT DOCUMENTS 2,921,442 A * 1/1960 Laborde et al. ..... 405/207
3,217,681 A * 11/1965 Thorton et al. ..... 114/265
3,776,167 A 12/1973 Marbury, Jr.
3,785,313 A * 1/1974 Rosenberg ..... 114/266
3,815,540 A * 6/1974 Peereboom ..... 114/248
4,156,577 A * 5/1979 McMakin ..... 405/196
4,744,697 A * 5/1988 Coppens ..... 405/204
4,829,924 A * 5/1989 Dysarz ..... 114/32
5,421,676 A * 6/1995 Wybro et al. ..... 405/223.1
5,855,455 A 1/1999 Williford et al.
5,997,217 A * 12/1999 Verret ..... 405/196
6,139,224 A * 10/2000 Michel et al. ..... 405/224
6,171,028 B1 * 1/2001 Van Gelder ..... 405/209
6,276,876 B1 * 8/2001 Bone et al. ..... 405/205
6,336,419 B1 * 1/2002 Breivik ..... 114/248
6,347,909 B1 * 2/2002 Kocaman ..... 405/209

FOREIGN PATENT DOCUMENTS

GB 2301800 12/1996
WO WO9912806 3/1999

* cited by examiner

*Primary Examiner*—Robert E. Pezzuto
*Assistant Examiner*—Thomas A. Beach

(57) ABSTRACT

A bore well in a seabed (27) may be established and/or operated by a drilling barge (10). The barge may be pulled onto a larger vessel (11) and transported to a drilling site. Alternatively, the larger vessel is divided longitudinally into a pair of sub-vessels, which are then re-united at the drilling site, where the barge is pulled into position on the larger vessel. The combined drilling vessel (10, 11) may thereafter be anchored in the desired position relative to the bore well by submerging the larger vessel to rest on the seabed. The barge may be arranged on top of the larger vessel by submerging one end of the larger vessel, towing the barge into a desired position relative to the larger vessel, and raising the submerged end of the larger vessel so as to bring the deck of the larger vessel into contact with the bottom of the barge and to lift the barge out of the water.

40 Claims, 11 Drawing Sheets

Figure 1:
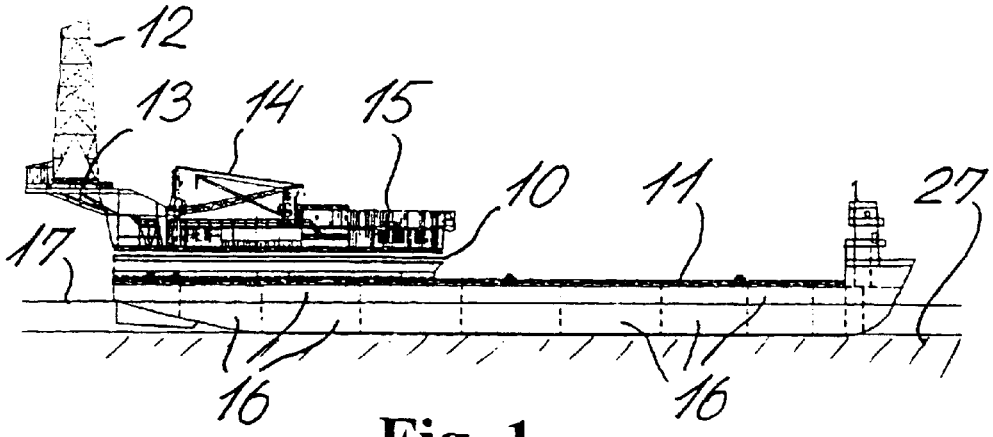

METHOD OF ESTABLISHING AND/OR OPERATING A BORE WELL IN A SEABED AND A DRILLING VESSEL FOR USE IN CONNECTION THEREWITH

The present invention relates to a method of establishing and/or operating a bore well in a bed or floor under a body of water by means of a drilling barge having a derrick and associated drilling equipment. Such drilling barges may be used for drilling in shallow and calm water areas, such as shallow lakes, river mouths etc. When a drilling barge is to be moved from one drilling site to another distant location it can not be moved over rough waters.

The present invention provides a method, which may improve the usability of a drilling barge. Thus, the present invention provides a method of establishing and/or operating a bore well in a bed or floor under a body of water by means of a drilling barge having a derrick and associated drilling equipment, said method comprising: arranging the drilling barge on top of another, larger floatable vessel, moving the floatable vessel to a location of operation, and anchoring the drilling barge in relation to a bed under said body of water so as to substantially align the derrick with an existing or planned bore well.

By using the method according to the invention an existing drilling barge may be made more versatile. While the existing drilling equipment and auxiliary equipment on the drilling barge may be fully utilised, the larger vessel on which the barge is arranged may lift the derrick to an elevated position, whereby also existing bore wells extending downwards from a platform positioned well above the water surface may be serviced and operated. Furthermore, because the drilling barge is arranged on top of a relatively large vessel anchored to the seabed or sea floor, the drilling barge may be used also in less calm and deeper areas than if the barge had been used separately. Finally, the larger vessel carrying the drilling barge may be used as a means of transportation, which is more resistant to less favourable weather conditions than the drilling barge in itself.

The drilling barge may be positioned on the other floatable vessel in any known manner, for example by means of a stationary or floating crane. However, according to the invention the arranging step may include submerging at least one end of the larger vessel, towing the drilling barge into a desired position in relation to the larger vessel, and raising the submerged end of the larger vessel so as bring the deck of the larger vessel into contact with the bottom of the drilling barge and to lift the drilling barge out of the water.

The larger vessel may be submerged and later raised by pumping water into and out from selected water tanks or chambers contained in the larger supporting vessel. Therefore, the drilling barge may be positioned on top of the other vessel, such as a larger barge or another ship, exclusively by means present on the larger vessel. It is possible to submerge the whole supporting vessel. However, it is more preferred to submerge only the end of the vessel on which the drilling barge should be positioned. Thus, the stern of the larger vessel may be submerged and the drilling barge may thereafter be towed into the said position by towing means arranged on the larger vessel. The towing means may, for example, be a winch with a wire, which may be connected to the stem of the drilling barge. The drilling barge is preferably towed or pulled to a position in which the major part is supported on the deck of the larger vessel, while the part of the drilling barge carrying the derrick and other drilling equipment extends beyond the stern of the larger supporting vessel.

The larger vessel carrying the drilling barge may be floating when the equipment on the drilling barge is operating for drilling a bore hole or bore well in the sea floor or for operating or servicing an existing bore well. In such case the anchoring of the drilling barge includes anchoring of the larger vessel in relation to the bed under the body of water, the drilling barge being fastened immovably in relation to the vessel. The larger floatable vessel may be anchored to the sea floor by mooring lines or other known anchoring means. Such anchoring means may be of the quick-release type such that the drilling vessel may be released quickly if required due to weather conditions or for other reasons. However, alternatively or additionally anchoring may be obtained by submerging the larger vessel so as to position the vessel in contact with said bed, whereby a very stable positioning of the vessel in relation to the sea floor may be obtained.

In order to allow selective adjustment of the height of the lower end of the derrick in relation to the water surface or existing bore well installations supporting spacing means may be arranged between the drilling barge and the larger vessel, so as to position the drilling barge and the drilling equipment thereon in a desired position in relation to the bed or installation. Such spacing means may be replaceable spacing members. In the preferred embodiment, however, the spacing means may comprise hydraulic rams for adjusting the height of the drilling barge and of the derrick positioned thereon.

The drilling barge occupies only a minor part of the deck space of he larger vessel. Therefore, a crane may be positioned on the deck of the larger vessel and may be used for preparing the drilling site, such as for replacing damaged or defective parts of bore well installations.

Even though the main purpose of the larger vessel is to support the drilling barge it may also be used for transporting the drilling barge from one location to a distant second location or drilling site. Because the larger vessel is more seaworthy than the drilling barge the combined vessel may be towed over more rough waters than the separate drilling barge. However, when the transport takes place along more calm waterways it may be preferred to tow the drilling barge and the larger vessel separately, and if the waterways are so narrow that the larger vessel is not allowed to pass as a separate unit, the larger vessel may be divided longitudinally into two separate sub-vessels so as to allow transportation of the vessel on rivers and other narrow waterways, the sub-vessels being subsequently reunited to re-establish said vessel, whereupon the drilling barge may be lifted or pulled into position on top of the large vessel so as to establish the combined drilling vessel, which may then be put into operation. The sub-vessels may advantageously be reunited by pulling them together by means of wires and associated drawing equipment, such as anchor winches, bollards and other standard marine equipment arranged on these sub-vessels.

The drilling barge may later again be disconnected from the larger vessel and used separately at said second drilling site, when the height or depth of the water body does no exceed a predetermined low value, and where larger waves do not occur.

The larger vessel does not function only as a support or base for the drilling barge, but the space on deck of the larger vessel not occupied by the drilling barge may be used for several other useful purposes in support of the activities performed by the equipment on the drilling barge. As examples such space may be used for personnel accommodation storage area and/or workshop area, etc. to support various offshore operations.

The method according to the invention may be used in connection with drilling and related activities, including activities in connection with the preparation, operation and service of production wells. Thus, as an example, the combined drilling barge and larger vessel may be used for assembling and laying a pipeline on the seabed below the body of water, pipe lengths from the storage area being interconnected at the workshop area so as to form a pipeline, which is gradually immersed into the body of water as it is being formed. Preferably, when the pipeline is being immersed it may pass through a tensioning system suspended in the derrick of the drilling barge.

The present invention further provides a drilling vessel comprising a drilling barge having a derrick and associated drilling equipment, and a larger supporting floatable vessel, which is adapted to receive the drilling barge on its upper deck in a position in which the drilling barge part carrying the derrick extends beyond the deck of the supporting vessel, means being provided for interconnecting the drilling barge and the supporting vessel in said position. The drilling vessel, which may, for example, be used in carrying out the method according to the invention, and the drilling vessel may be constructed and equipped as described above. Furthermore, the larger vessel may comprise towing or pulling means for towing or pulling the drilling barge into position on the deck of the larger vessel as described above.

The drilling vessel may comprise means for anchoring the supporting vessel in relation to the seabed. Such anchoring may comprise mooring lines of known types. Alternatively or additionally, the anchoring means may comprise means for submerging the supporting vessel so as to position said vessel in contact with the seabed. Such submerging means may comprise one or more water tanks or chambers within the supporting vessel and means, such as pumps, for selectively letting water into the tank or tanks and for removing water from the tanks.

The drilling vessel may comprise supporting spacing means arranged between the drilling barge and the supporting vessel, so as to position the drilling barge and the drilling equipment thereon in a desired position in relation to the seabed, and such spacing means may comprise hydraulic rams or jacks for adjusting the height of the drilling barge and of the derrick positioned thereon.

The supporting vessel may advantageously be divided longitudinally into two separate sub-vessels, so as to allow transportation of the vessel on rivers and other narrow waterways. The supporting vessel may be an existing conventional vessel or large barge, which has been cut longitudinally into two separate parts being reconstructed so as to form two individually floatable vessels. These sub-vessels are then provided with connection means, which are preferably releasable. These connection means may comprise wire-pulling means being mounted on the sub-vessels for pulling the sub-vessels together. Thus, the sub-vessels may be reunited and form a combined supporting vessel without any requirement for docking or support from a shipyard.

According to another aspect, the present invention relates to a use of a floatable vessel for carrying or supporting a smaller drilling barge, while the drilling barge is being used for performing drilling operations. The larger supporting vessel may be floating when the drilling equipment on the drilling barge is operating. However, when permitted by the conditions at the drilling site the larger vessel is preferably submerged.

According to a further aspect the present invention provides a method of establishing and/or operating a bore well in a bed or floor under a body of water at a selected location of operation by means of a drilling barge or vessel having a derrick or rig and associated drilling equipment, said method comprising: providing a plurality of separate, floatable sub-vessels at a first location remote to the selected location of operation, towing the sub-vessels from the remote first location to a second location adjacent to or closer to the selected location of operation, interconnecting the sub-vessels at said second location so as to form a barge, mounting the derrick or rig and associated drilling equipment on the barge thus formed, moving the drilling barge to the selected location of operation, and anchoring the drilling barge in relation to the bed or floor under said body of water so as to substantially align the derrick with the existing or planned bore well.

Thus, instead of positioning a smaller drilling barge on top of a larger barge as explained above, a drilling rig or a derrick and associated drilling equipment may be mounted directly on the deck of the larger barge, which is divided into interconnect able sections or sub-vessels. Thus, the drilling barge may be produced in a shipyard at a location far away from the place where the drilling barge is to be used. The floatable sub-vessels may then be towed or transported otherwise to a location, where the sub-vessels may be assembled to form a barge. The assembling is preferably performed at or close to the location at which the drilling barge is to be used.

The size and dimensions of the sub-vessels may be chosen depending on the intended means of transportation to the location of operation of the drilling barge. As an example, the size and dimensions of the sub-vessels may be chosen so as to allow towing or tugging of the sub-vessels on rivers and other narrow waterways by means of a tugboat The sub-vessels being interconnected preferably comprise a number of elongated first sub-vessels arranged in side-by-side relationship and extending in the longitudinal direction of the barge. In order to further strengthen such structure the sub-vessels may further comprise a pair of second sub-vessels being arranged fore and aft, respectively, at the ends of the first sub-vessels so as to extend transversely to the first sub-vessels.

The sub-vessels are preferably at least partly floating when they are being assembled. Therefore, as an initial step they may be drawn together by means of drawing equipment, which may or may not be associated with the sub-vessels, such as winches, hydraulic cylinders, etc., and subsequently temporarily interconnected by mechanical interlocking means, such as books latches, or the like. When such an interim interconnection has taken place the sub-vessels may be interconnected more permanently, for example by welding. Each pair of adjacent sub-vessels are preferably welded together adjacent to the deck level and adjacent to the bottom level, respectively. In order to facilitate the welding operation the adjacent sub-vessels are preferably mutually spaced in their said temporarily interconnected condition. This may, for example, be obtained by means of connecting flanges, which are formed on and extend outwardly from the sub-vessels so as to bridge said spacing, whereby the flanges may function as spacing means. The lowermost flanges are preferably positioned above the water level allowing a person to move within the space defined between adjacent sub-vessels and to weld each flange on one sub-vessel to the adjacent sub-vessel. Thereby the sub-vessels may be permanently interconnected by dry welds within the protected area formed by the space between the adjacent sub-vessels.

The rig or derrick used on the drilling barge according to the invention may be of any suitable type, such as the usual land-based type. The rig and other necessary drilling equipment may be disassembled to an extent allowing the desired manner of transportation, such as by land, sea and/or river, to the place where the drilling barge is to be assembled. Alternatively, however, the rig or derrick may be mounted on the barge by arranging a smaller drilling barge comprising such rig or derrick and associated drilling equipment on the deck of the larger barge. Thereby an existing small drilling barge may be used in combination with a larger barge being composed by a number of sub-vessels as explained above.

When the drilling barge has completed its mission and is to be used at another remote drilling site, the more permanent interconnections or welds between adjacent sub-vessels may be cut or separated so as to divide the barge into said sub-vessels. Thereafter, the sub-vessels may be towed along rivers or other narrow waterways to the new site of operation.

The present invention further provides a drilling barge comprising: a plurality of separately floatable, sub-vessels having tanks formed therein, each sub-vessel having connecting means for interconnecting the sub-vessels in a floating condition and each sub-vessel defining a deck part and a bottom part forming in the interconnected condition of the sub-vessels the deck and the bottom, respectively, of the barge, and a drilling rig or derrick to be mounted on the deck of the barge.

The rig or derrick may be positioned at the aft part of the barge so as to extend beyond the outer limits of the barge. In the preferred embodiment, however, the rig or derrick is positioned above and in alignment with a through opening or cutout defined in the barge. The barge may further comprise all accessories necessary for performing drilling operations and/or production of petroleum products, whereby drilling operations and oil production is possible also in very remote areas where support and supplies can not be obtained easily.

Figure 2:
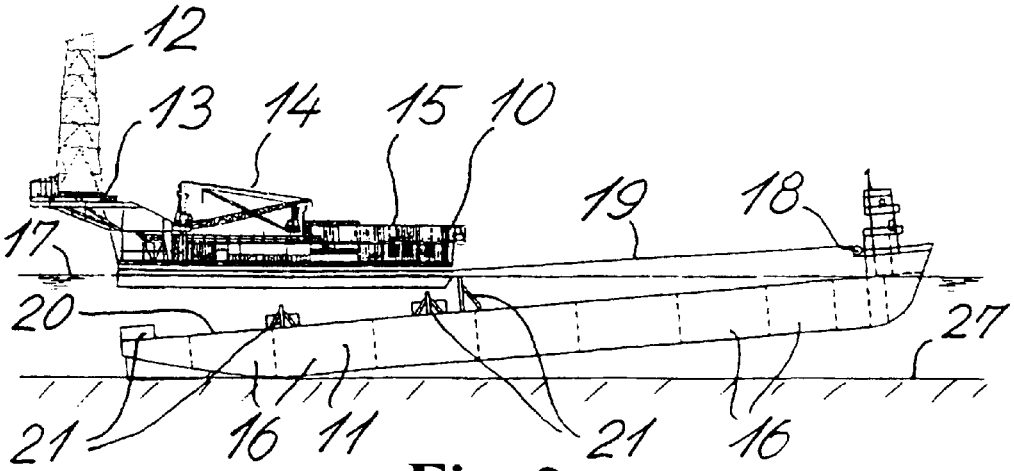
Figure 3:
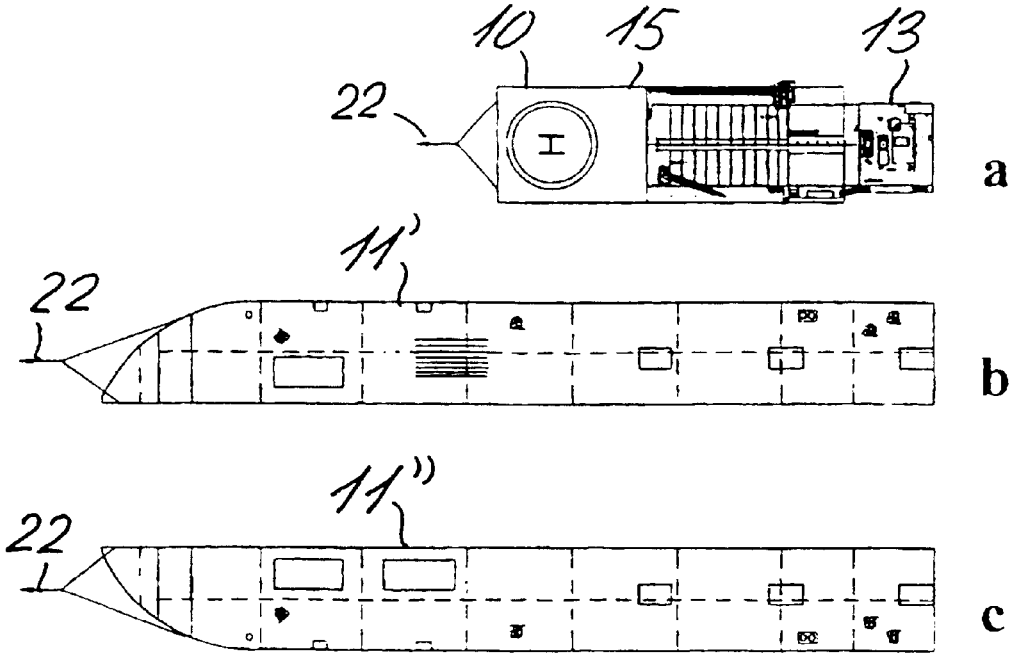
Figure 4:
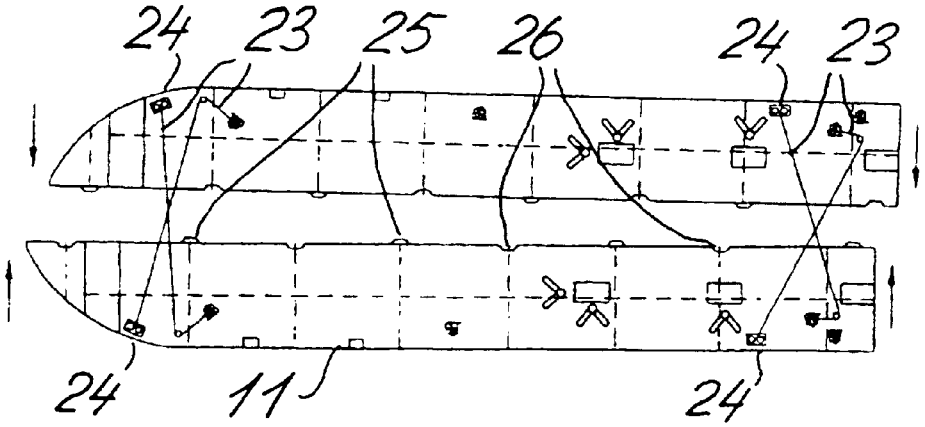
Figure 5:
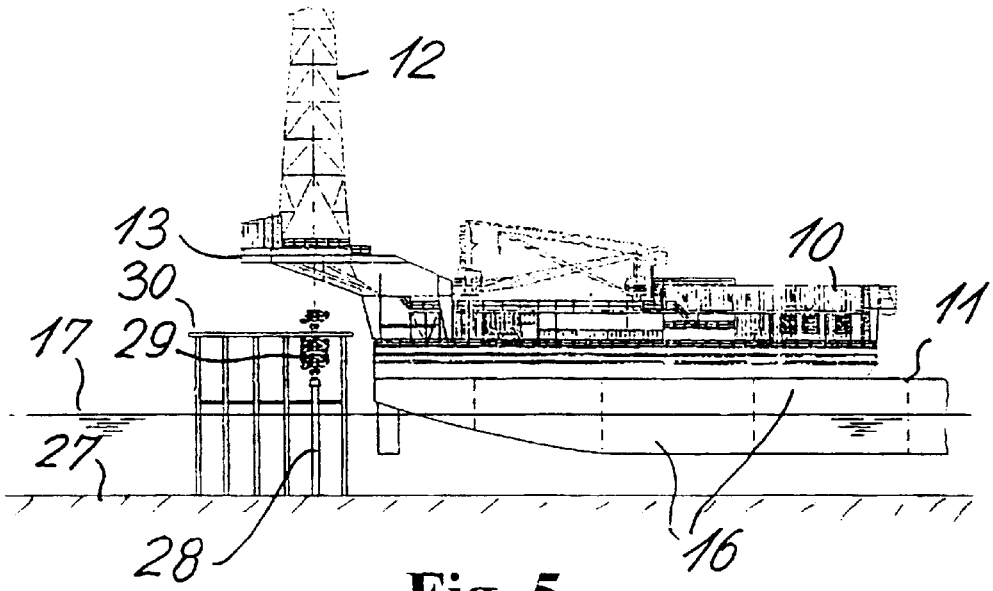
Figure 6:
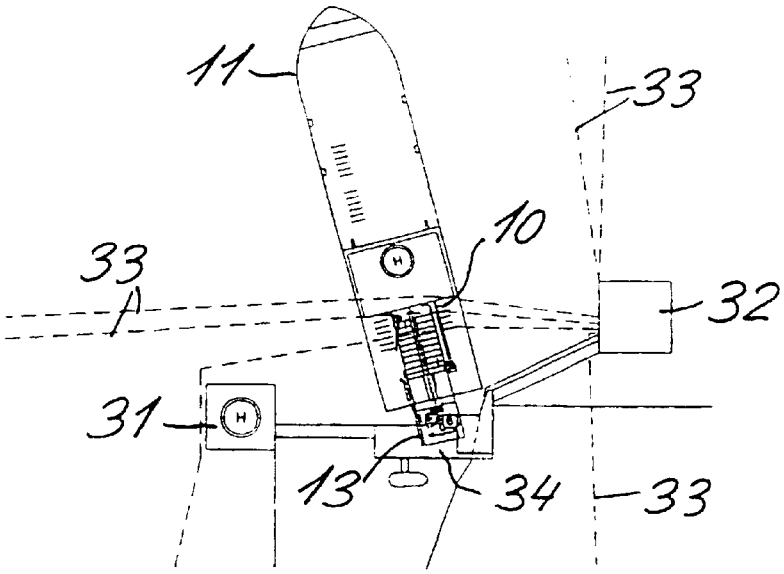
Figure 7:
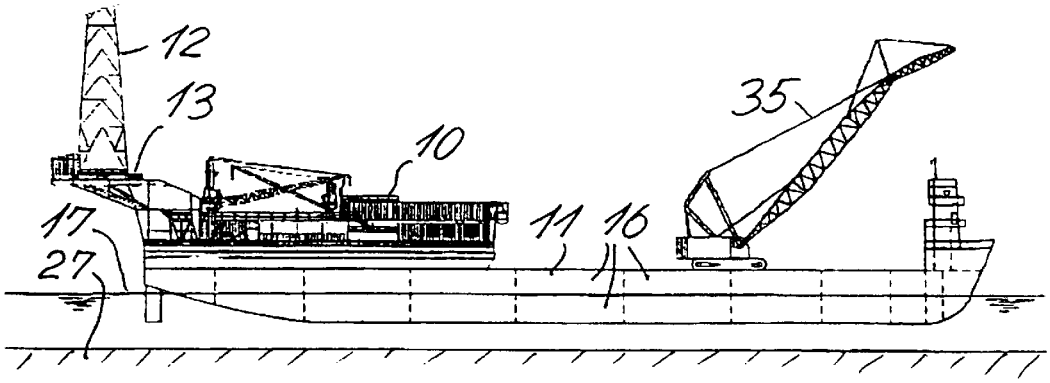
Figure 8:
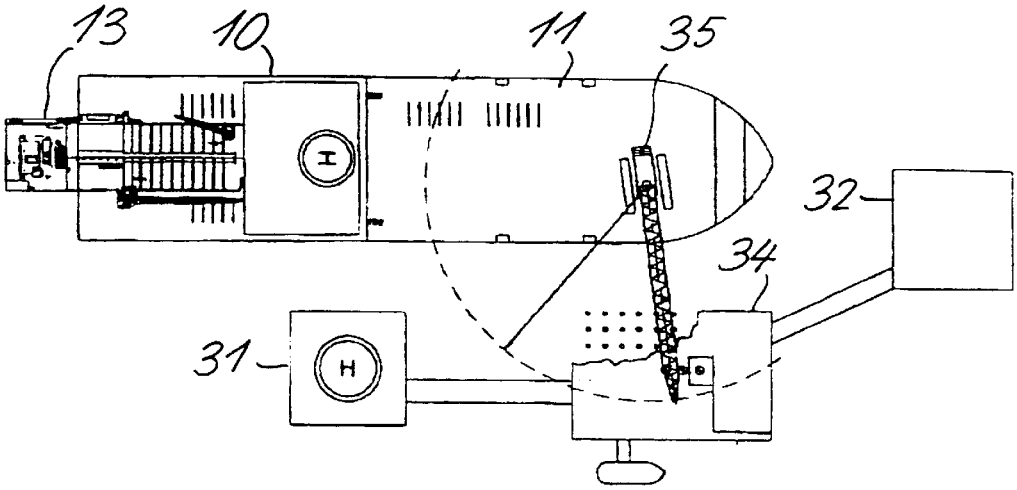
Figure 9:
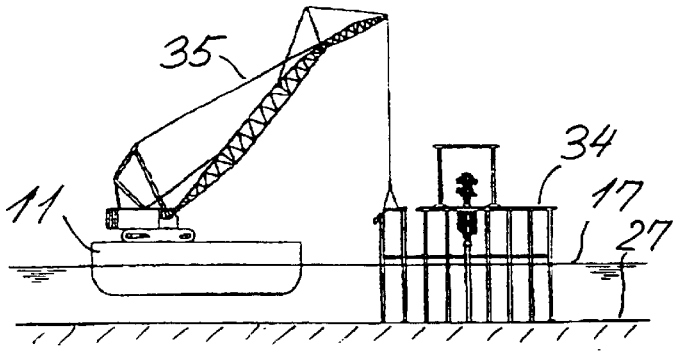
Figure 10:
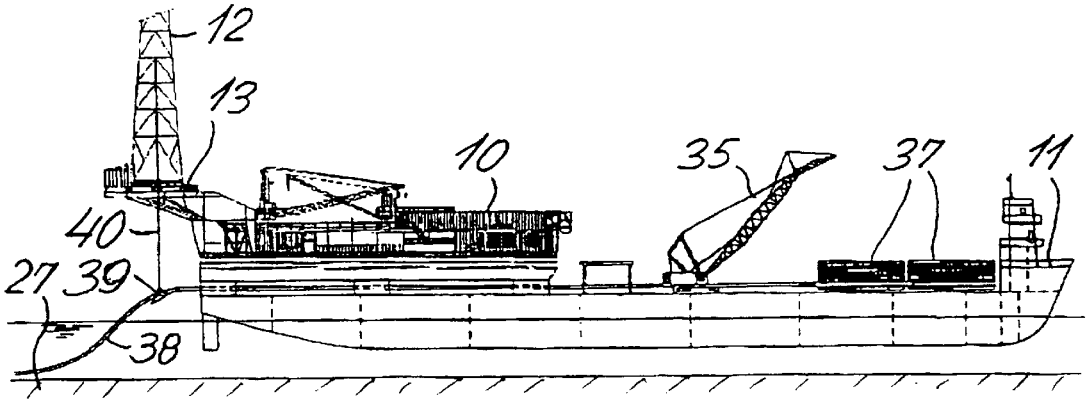
Figure 11:
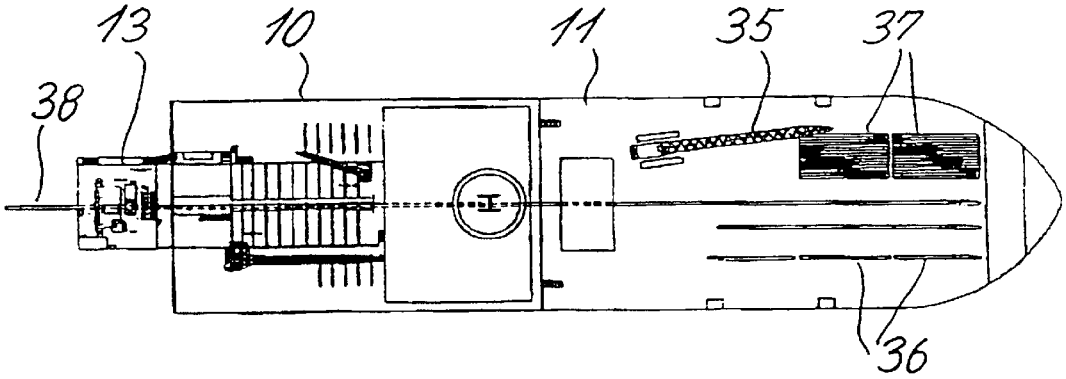
Figure 12:
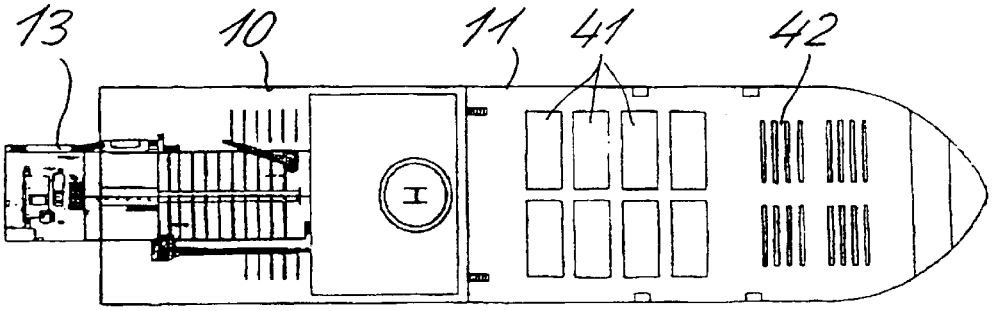
Figure 13:
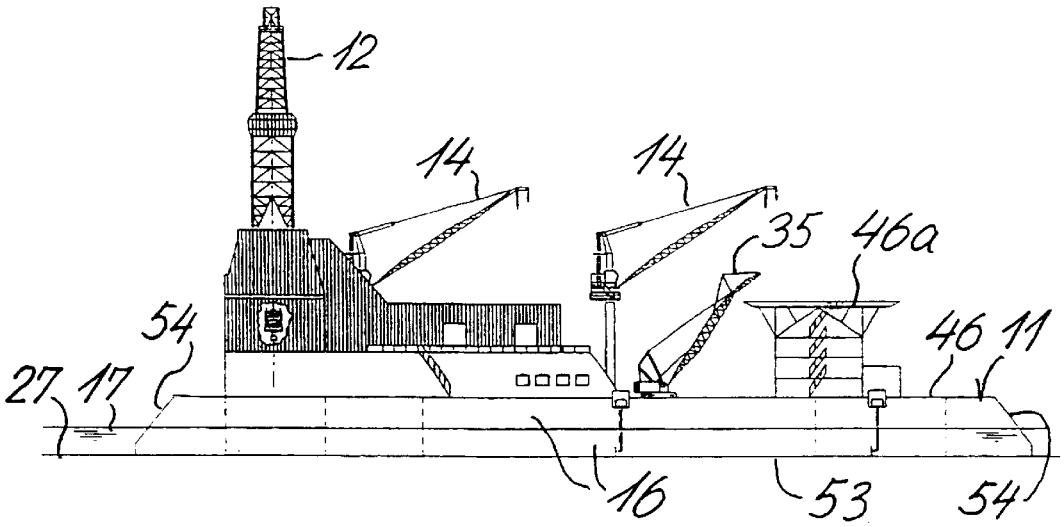
Figure 15:
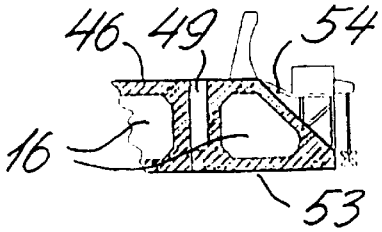
Figure 14:
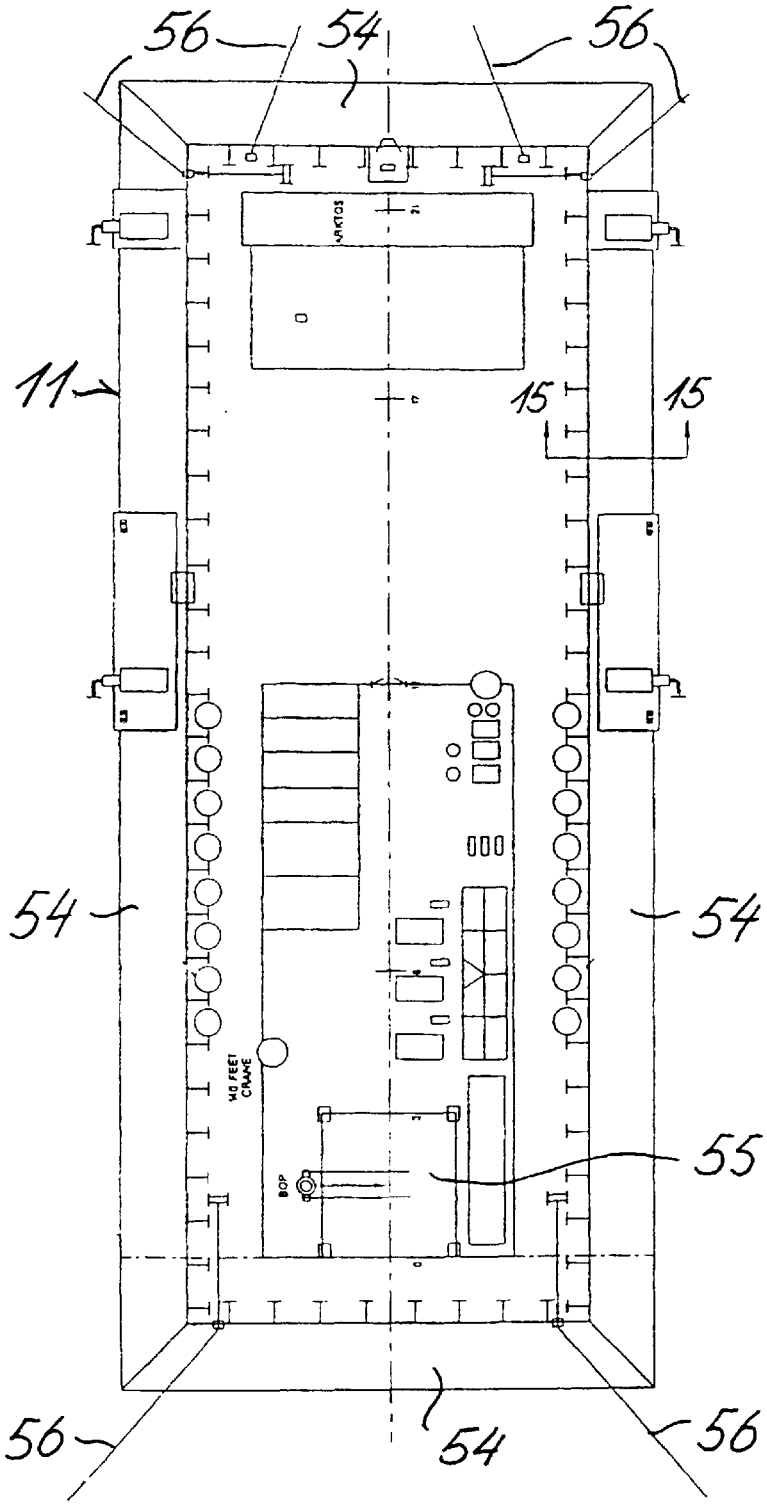
Figure 16:
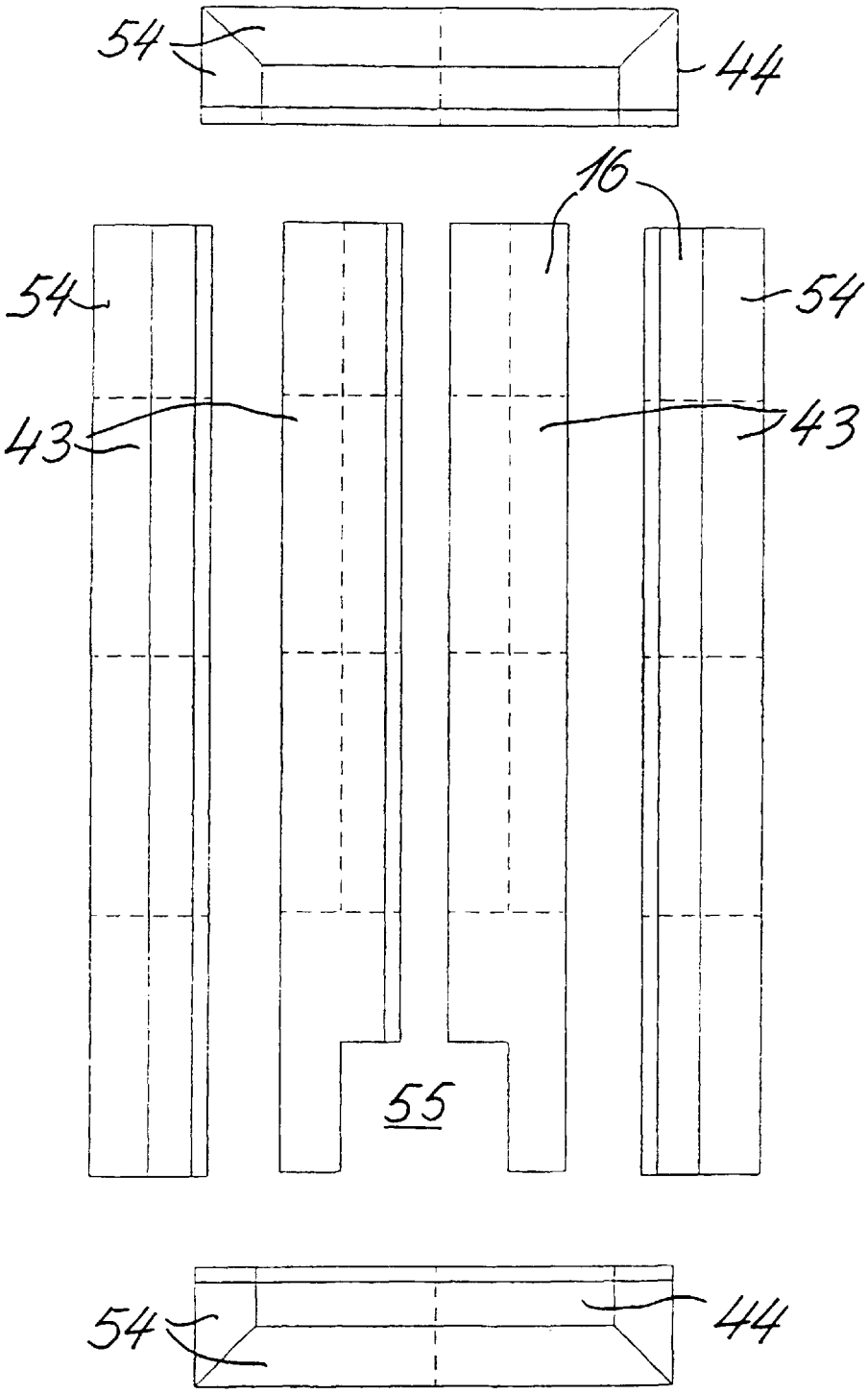
Figure 17:
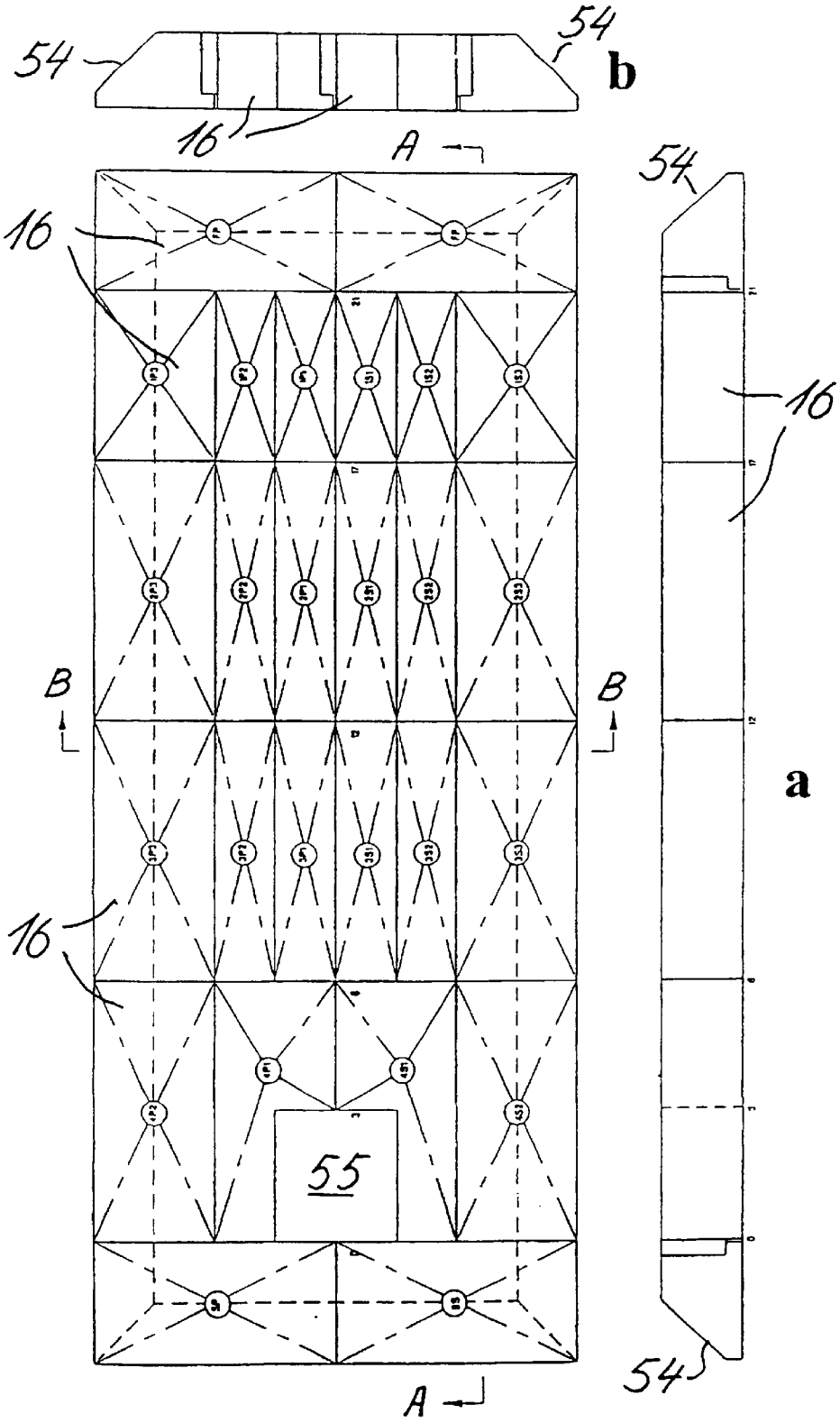
Figure 18:
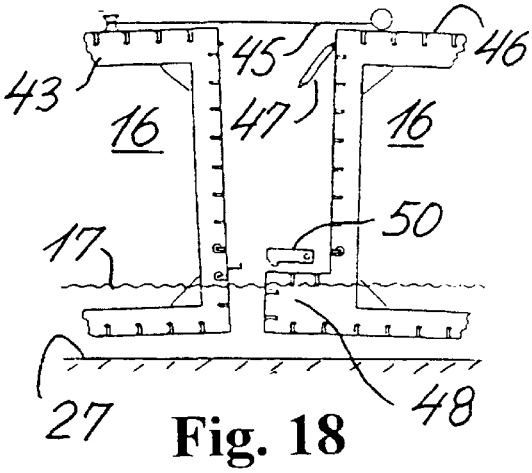
Figure 21:
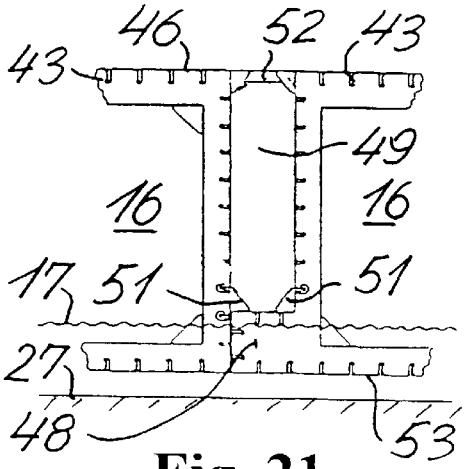
Figure 22:
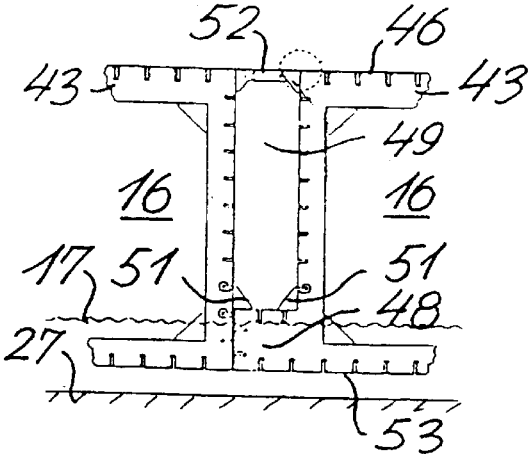
Figure 23:
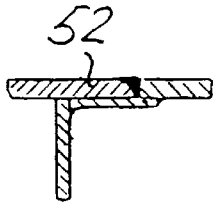

The invention will now be further described with reference to the drawings, wherein FIG. 1 is a side view of an embodiment of the drilling vessel according to the invention comprising a drilling barge arranged on top of a larger vessel, FIG. 2 is a side view illustrating how the drilling barge may be moved to a position on the deck of the larger vessel, FIG. 3 is a top view of a second embodiment of the drilling vessel according to the invention separated into three units, FIG. 4 is a top view illustrating how the sub-vessels into which the larger vessel is divided may be reunited so as to form a vessel for supporting the drilling barge, FIG. 5 is a side view showing the drilling vessel according to FIG. 1 in operation, FIG. 6 is a top view of a drilling vessel according to the invention in operation, FIG. 7 is a side view of a drilling vessel according to the invention provided with a crawling crane on the deck of the larger vessel, FIGS. 8 and 9 are top and end views, respectively, showing the drilling vessel shown in FIG. 7 in operation, FIGS. 10 and 11 are side and top views, respectively, of a drilling vessel in accordance with the invention being used for laying a pipeline on the sea floor, FIG. 12 is a top view of a further embodiment of the drilling vessel according to the invention, FIG. 13 is a side view of a still further embodiment of the drilling barge according to the invention, FIG. 14 is a top view of the drilling barge shown in FIG. 13, FIG. 15 is a sectional view along the line 15—15 in FIG. 14, FIG. 16 is an exploded top view of the hull of the barge shown in FIGS. 13 and 14 illustrating the sub-vessels forming the barge hull, FIGS. 17, 17*a*, and 17*b* diagrammatically show a bottom view, a longitudinal sectional view along the line A—A, and a cross-sectional view along the line B—B, respectively, of the hull of the barge shown in FIGS. 13–15 illustrating the arrangement of tanks defined within the various sub-vessels, FIGS. 18–22 illustrate various steps of interconnecting adjacent sub-vessels, and FIG. 23 is a cross-sectional view in an enlarged scale of the weld indicated by a dotted circle in FIG. 22.

FIGS. 1–12 illustrate embodiments of the drilling vessel according to the invention each comprising a conventional drilling barge 10 of the type used for drilling operations in shallow water areas and a larger vessel or barge 11. The drilling barge 10, which is positioned on the stern end of the deck of the larger vessel 11, comprises a derrick 12 with a drill floor 13. The drilling barge is also provided with conventional drilling equipment necessary to perform a drilling operation. The drilling barge may further be provided with cranes 14, accommodation 15 for crew, etc. The larger vessel 11 may be a larger barge, but may in principle be any other type of vessel or ship being of a suitable size and having a deck area adapted to receive the drilling barge 10. The vessel 11 preferably contains a number of tanks or chambers 16 and pumps (not shown), for selectively pumping water into and out of any of such tanks.

The drilling barge 10 and the larger vessel are separate units, which may operate independently. However, in order to increase the versatility and usefulness of the drilling barge it may be moved to a position on the deck of the larger vessel 11. FIG. 2 illustrates how the drilling barge 10 may be conveniently moved onto the deck of the vessel 11. While the drilling barge 10 is floating at the water surface 17 the stern end of the vessel 11 is submerged by pumping water into the after tanks or chambers 16. Now, the stern of the barge 10 is connected to a tugging wire 18 from a winch 19, and the floating drilling barge 10 is pulled to a position immediately above the submerged after deck part 20 of the vessel 11, vide FIG. 2. This after deck part 20, which is adapted to support the drilling barge 10, is defined by means of uprights 21, which may be in the form of spacing means such as hydraulic rams, extending from the deck of the vessel 11. When the barge 10 is in the desired position the stern end of the vessel 11 is raised by pumping water out of the tanks 16, whereby the barge 10 is positioned on the after part of the deck of the vessel 11 so that the drill floor 13 with the derrick 12 extends beyond the stern of the vessel 11. The combined drilling vessel may now be towed to a drilling site by means of a tugboat, or the vessel may be provided with other kinds of propulsion means, such as an outboard motor.

In some cases the drilling vessel has to be transported through river systems or other narrow waterways in order to arrive at the drilling site. If the larger supporting vessel 11 is too broad to pass such waterways it may be divided into a pair of sub-vessels 11' and 11" along a central, longitudinal plane. This means that the drilling vessel according to the invention may be divided into three units as illustrated in FIG. 3, namely a conventional drilling barge 10 shown in FIG. 3*a* and two sub-vessels 11' and 11" illustrated in FIGS. 3*b* and 3*c*, respectively. As indicated by arrows 22 each of the units 10, 11' and 11" may separately be towed to a site of operation, for example through river systems by means of a suitable tug vessel, not shown.

When the separate units shown in FIG. 3 have arrived at their destination the two sub-vessels 11' and 11" may be re-united so as to form the larger supporting vessel 11. As shown in FIG. 4 this may be done by pulling the sub-vessels together by means of wires 23 and associated winches 24 mounted on the decks of the sub-vessels 11' and 11". Thus, the free end of a wire from a winch mounted on one of the sub-vessels is connected to the other sub-vessel, whereby the sub-vessels may be pulled together by operating the winches 24. Furthermore the contacting surfaces of the sub-vessels may be provided with releasable locking means including locking projections 25 and complementary shaped indentations 26 for receiving the projections 25. When the sub-vessels 11' and 11" have been interconnected the drilling barge 10 may be arranged on the deck of the now formed larger vessel 11, where after the drilling vessel thus formed is ready for operation.

FIG. 5 illustrates how a drilling vessel according to the invention may be used in connection with a bore well in the seabed or sea floor 27. The oil well comprises a well tube 28, which is provided with a so-called "Christmas Tree" 29, and a drilling platform 30. The drilling vessel is positioned such that the well tube 28 and the derrick 12 of the barge 10 are substantially co-axial. In FIG. 5 the drilling vessel is floating and is maintained in the desired position by a plurality of mooring lines, not shown, extending between the supporting vessel 11 and anchors located at the sea floor 27. If the conditions at the drilling site permit a better "anchoring" of the drilling vessel may be obtained by locating the supporting vessel 11 in a submerged position in which the bottom of the vessel 11 is resting on the sea floor 27 as illustrated in FIG. 1. This may be obtained by reducing the buoyancy of the vessel 11 by pumping water into the tanks or chambers 16. It should be understood that the drilling vessel according to the invention may be used not only for drilling operations and associated operations, such as positioning of lining tubes in the bore well, but also for servicing and repair.

FIG. 6 shows a drilling vessel according the invention in operation in an oil field, which comprises an accommodation platform 31, a production platform 32 from which a number of pipelines 33 extend along the sea floor 27, and a drilling platform 34. The drilling vessel is positioned and anchored (with the supporting vessel 11 floating or submerged) in such a position in relation to the drilling platform 34 that the drill floor 13 is located vertically above the bore well of the drilling platform 34.

FIGS. 7–9 shows a drilling vessel as that shown in FIGS. 1 and 2, but provided with a crawler crane 35 movable on the fore end of the deck of the supporting vessel 11. FIG. 8 is a top plan view illustrating the oil field shown in FIG. 6 and how the crawler crane 35 may be used for repairing a possibly damaged drilling platform 34. FIG. 9 is an end view illustrating the same situation.

FIGS. 10 and 11 illustrate how the drilling vessel shown in FIGS. 7–9 may also be used for assembling tube sections 36 from a stock 37 so as to form a pipeline 38, which is currently positioned on the sea floor 27. The pipeline formed may pass through a tensioning device 39, which is suspended from the derrick 12 in a wire 40. The drilling vessel is moving forwards with a speed corresponding to the rate at which the pipeline 38 is formed.

FIG. 12 is a top plan view of a further embodiment of the drilling vessel according to the invention, where the fore end of the deck of the supporting vessel 11 is utilised in a different manner. In FIG. 12 the deck of the vessel 11 not occupied by the drilling barge 10 is used for accommodation containers 41, workshops and/or as a storage area 42 to support various offshore operations. Depending on the intended use additional containers, racks for storing for example tube sections, etc. could be installed.

FIGS. 13–23 illustrate a further embodiment of the method and drilling vessel according to the invention, and parts similar to those of the embodiments described above are designated by similar reference numbers. In contrast to the embodiments with reference to FIGS. 1–12, in which existing vessels not especially designed for the purpose are used, FIGS. 13–17 illustrate a drilling vessel comprising a specially designed barge 11. As illustrated in FIG. 16 the barge 11 is composed by a number (in the present embodiment four) of longitudinal sub-vessels 43 and a number (in the present embodiment two) of transverse sub-vessels 44. Each of the sub-vessels 43 and 44 has one or more tanks or chambers 16 and is a floatable, self-supporting vessel. Thus, the sub-vessels 43 and 44 may be towed from one location—for example the shipyard, where they have been produced—to a remote location, where the drilling barge is to be used.

When a drilling barge 11 as that shown in FIGS. 13 and 14 is to be used for drilling operations in shallow water at a remote location the sub-vessels 43 and 44 may be towed to the location of use by means of a tugboat, for example via rivers or other narrow waterways where the assembled barge 11 would not be able to pass. The rig 12, cranes 14, 35 and other accessories may also be transported along the same waterways or over land in a disassembled condition. When the sub-vessels 43 and 44 have arrived at the location of operation or at another location from which the assembled barge 11 may be towed to the location of use, the sub-vessels 43 and 44 may be assembled so as to form the barge 11 shown in FIGS. 13 and 14.

Figure 19:
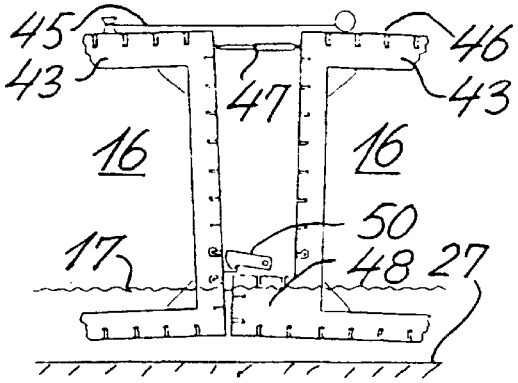
Figure 20:
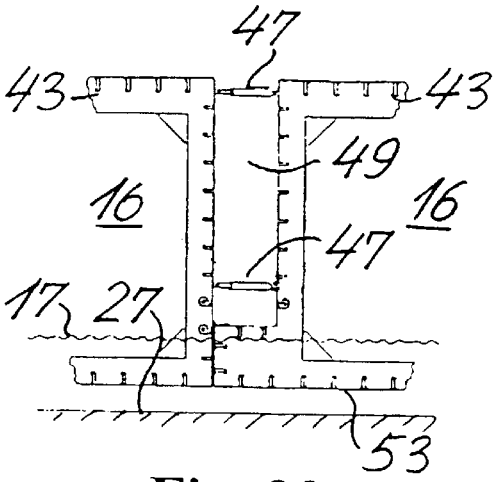

The manner in which a pair of longitudinal sub-vessels 43 may be assembled is illustrated in FIGS. 18–22. As a first step, the sub-vessels floating in water is pulled towards each other by means of a wire/winch arrangement 45 mounted at the upper deck 46. When the sub-vessels have been moved sufficiently close to each other they are interconnected by a number of hydraulic jacks 47 as shown in FIG. 19. As shown in FIGS. 18–22 one of the sub-vessels 43 has a protruding bottom flange 48 such that a space or cofferdam 49 is defined between adjacent sidewalls of the sub-vessels 43 when they have been pulled together. In this position the sub-vessels may be locked together by mechanical locking means 50. The flange 48 is positioned such that at least the upper part of the flange is above the water surface level 17 and a welding operator may now permanently interconnect the sub-vessels 43 by means of weld seams 51. It is a big advantage that the welding operation may take place within the cofferdam 49 so that the sub-vessels may be assembled by a "dry" weld while they are floating. Thus, it is neither necessary to bring the sub-vessels to a dry dock—if at all available—nor to weld under water by divers, which would be more costly and reduce the quality of the weld. Finally, the upper part of the cofferdam 49 may be closed by a plate member 52 being welded to the upper deck 46, for example as illustrated in FIGS. 21 and 22 and more in detail in FIG. 23.

When all of the longitudinal sub-vessels 43 have been interconnected in this manner, the transverse sub-vessel 44 may be connected to the ends of the interconnected sub-vessels 43 for and aft in a similar manner. The barge hull now produced has an upper deck 46, a flat bottom 53 and upwardly and inwardly sloping side surfaces 54, which are suited to withstand ice formations. The shape of the sloping side surfaces is best shown in FIG. 15. A derrick or rig 12, which may, for example be of the land based type, and conventional accessories may now be mounted directly on the upper deck 46 of the barge hull formed such that the rig or derrick 12 is aligned with a through opening 55 defined in the hull of the barge 11, see FIGS. 14, 16 and 17. Cranes 14 and 35, a helicopter deck 46*a* and other equipment conventionally used on a drilling vessel may also be placed or mounted on the upper deck 46.

When the drilling barge 11 thus produced has been positioned at the drilling site water may be pumped into at least some of the internal tanks or chambers 16 so as to place the flat bottom 53 of the barge 11 in contact with the sea floor 27 and/or the barge 11 may be held in position by mooring lines 56, see FIG. 14.

FIGS. 17, 17*a* and 17*b* illustrates a possible arrangement of tanks or chambers defined within the hull of the drilling barge 11.

EXAMPLE 1

An offshore oil field at Bahrgansar in Iran comprises three platforms situated on piles, namely (as shown in FIG. 8) an accommodation platform 31, a production platform 32 and a drilling platform 34. The oil field further comprises six satellite platforms each having one well and a pipeline to the production platform. The water depth in the area is varying from about 4.5 m to about 8 m. During the war between Iran and Iraq the drilling platform was severely damaged and approximately half of the drilling platform is now gone with only the rammed piles left. Also the derrick and the drill floor are badly damaged and beyond repair. A lot of fragments from bombing and the resulting fire have damaged the remaining platform. The wellheads are not damaged. The production platform is still producing and the other two wells were plugged, but with moderate success only. Thus, a lost piece of drill pipe is left in one of these wells and in the other well a 900 m long drill string is hanging in the slips.

It is proposed to bring the above mentioned oil field to its full production level by means of a drilling vessel according to the present invention as illustrated in FIGS. 1, 2 and 5–12. It is possible to use an existing drilling barge 10 presently located in Venezuela, because when the barge 10 is placed on the deck of the larger vessel 11 it is possible to tow the combined drilling vessel to the oil field in Iran.

The main particulars of the drilling vessel thus provided may be as follows:

| | |
|---|---|
| overall length | 135 m |
| overall width | 30.5 m |
| lightweight | 5,880 metric tonnes |
| accommodation | 70 men (upgraded from 38 men) |
| rated drilling depth | 6,095 m (20,000 feet) |

Particulars of main drilling equipment may be as follows:

| | |
|---|---|
| derrick | DRECO 147 ft., 1000,000 lbs. capacity |
| mud pumps | 2 x Oilwell A-1700-PT |
| rotary table | Oilwell B37½" w/electric drive |
| drawworks | Oilwell E-2000 with Elmagco electric brake |

Operating environmental criteria:

| | |
|---|---|
| maximum winds speed | 20 m/s |
| water depth + spring tide + penetration of vessel 11 into sea floor maximum | 10.7 m |

The above oil field may be repaired and overhauled by means of the drilling vessel specified above and possibly provided with a crawler crane 35 as shown in FIGS. 7–9. Thereafter the damaged derrick and drill floor of the drilling platform 34 may be replaced by the derrick 12 and the drill floor 13 of the drilling barge 10, so that drilling operations may take place. The satellite platforms are located where the water depth is 4–5 m, and the above-specified drilling vessel also provides sufficient drill floor height over the satellite platforms even when the larger supporting vessel 11 is submerged and is resting on the sea floor. Furthermore, the derrick 12 of the drilling barge 10 may be used for positioning and piling new satellite platforms.

EXAMPLE 2

It is planned to drill several exploration wells in the shallow water areas in the Caspian Sea. For this purpose a drilling vessel according to the invention comprising the drilling barge 10 specified in Example 1 could conveniently be used. It is proposed to place the drilling barge 10 on a larger transporting vessel 11 in Venezuela and to tow the combined vessel to a suitable shipyard in the Baltic or Black Sea, where the transporting and supporting vessel 11 is cut longitudinally in two halves, and new longitudinal bulkheads will be installed to allow the sections of the larger barge or vessel 11 to be towed as separate vessels or sub-vessels 11' and 11" (FIG. 3) each with their own power generators, pumps, navigational lights etc. Furthermore, the sub-vessels may be provided with simple mechanical interlocking systems as described above in connection with FIGS. 3 and 4.

The drilling barge 10 and the sub-vessels 11' and 11" may now be towed separately through the internal Russian river system to a suitable location in the Caspian Sea. Without any need for shipyard facilities the sub-vessels may be reunited as described above in connection with FIG. 4, and the drilling barge 10 may be pulled in position on the larger vessel 11 as illustrated in FIG. 2. Now, the combined drilling vessel may be towed to its first drilling location by means of suitable tugs. At the drilling location the vessel is held in position by means of mooring lines, and the larger supporting vessel 11 is submerged so as to rest on the sea floor. Then the drilling operation may start.

Field Description

The described drill vessel according to the invention will have access to the following fields, where the penetration of the supporting vessel 11 into the seabed is expected to be between 10 and 40 cm.

| Field | Water depth | Surge range (50 years) |
|---|---|---|
| Kashagan East (KE) | 3.7 m | −1.5–1.6 m |
| Kashagan West (KW) | 7.2 m | −0.9–0.9 m |
| Kalamkas (KL) | 9.0 m | −0.9–0.9 m |

The main particulars of the drilling vessel may be as follows:

| | |
|---|---|
| overall length | 135/122 m |
| overall width | 30.5 m |
| height | 10.7/12.7/12.2/14.2 m |
| lightweight | 5,880 metric tonnes |
| accommodation | 38 men |
| rated drilling depth | 6,095 m (20,000 feet) |

Operating environmental criteria (50 years return period):

| | |
|---|---|
| maximum winds speed | 34 m/s |
| maximum current | 1 m/s |

The above example illustrates the flexibility or versatility of the drilling vessel according to the invention allowing an existing drilling barge 10 to be transported to and utilised at a distant location with very restricted accessibility.

EXAMPLE 3

The sections or sub-vessels for a multi-section barge of the type described above with reference to FIGS. 13–23 is planned to be fabricated, pre-assembled and tested in a shipyard at the Baltic Sea. After disassembling the sections or sub-vessels are towed to the Caspian Sea via the river waterways in Russia. As explained previously, re-assembly in the Caspian Sea may be carried out exclusively by using equipment, such as anchor winches, hydraulic cylinders and pre-installed locking devices present on the sub-vessels or barge sections. All structural assembly welds may be carried out with dedicated, on-board equipment and in "dry" condition above water level in a 2 m wide cofferdam. The barge thus assembled will be provided with an existing arctic (land) rig. The accommodations and the drilling equipment modules will be lifted into place using an on-board crawler crane. The re-assembly location can thus be any location, which is relatively sheltered in vicinity of a small harbour facility (Bautino, or similar) for temporary storage of various equipment. The drilling barge will be towed to its drilling location with tugboats. For shallow water depths not accessible for tugboats, self-contained thrusters (optional) can be used to bring the barge to its final drilling position.

The drilling barge is fully equipped for all-year drilling operations in the Northern Caspian Sea in water depths ranging from approximately 1.5 to 7.4 m. During summertime drilling capability in water depths up to 9.0 m is possible, depending on storm surges. When fully assembled and operational the barge has a total main deck surface area of approximately 6,100 $m^2$ (bottom area is 9,000 $m^2$), enabling operation for extended periods (up to three months) without supply boat tendering. For personnel emergency evacuation, the use of highly mobile all-terrain amphibious "Arktos" vehicles are envisaged.

It should be understood that the various modification and changes of the embodiments described above could be made without departing from the scope of the present invention.

What is claimed is:

1. A method of establishing and/or operating a bore well in a bed or floor under a body of water by means of a drilling barge having a derrick and associated drilling equipment, said method comprising the steps of:

arranging the drilling barge on top of another, larger floatable vessel;

arranging supporting spacing means between the drilling barge and the larger vessel;

moving the floatable vessel to a location of operation;

anchoring the drilling barge in relation to a bed under said body of water so as to substantially align the derrick with the existing or planned bore well, said anchoring comprising submerging the larger vessel so as to position the vessel in contact with said bed; and positioning the drilling barge and the drilling equipment thereon in a desired position in relation to the bed by the supporting spacing means.

2. A method according to claim 1, wherein the step of arranging the drilling barge on top of the larger vessel includes the steps of:

submerging at least one end of the larger vessel;

towing the drilling barge into a desired position in relation to the larger vessel; and raising the submerged end of the larger vessel so as bring the deck of the larger vessel into contact with the bottom of the drilling barge and to lift the drilling barge out of the water.

3. A method according to claim 2, wherein the stern of the larger vessel is submerged and the drilling barge is towed into the said position by towing means arranged on the larger vessel.

4. A method according to claim 1, wherein the spacing means comprise hydraulic rams for adjusting the height of the drilling barge and of the derrick positioned thereon.

5. A method according to claim 1, wherein a crane positioned on the deck of the larger vessel and is used for preparing the drilling site.

6. A method according to claim 1, wherein the larger vessel is used for transporting the drilling barge from one location to a distant second location.

7. A method according to claim 1, wherein the drilling barge and the floatable vessel are moved from one location to a distant second location separately, the larger vessel being divided longitudinally into two separate sub-vessels, so as to allow transportation of the vessel on rivers and other narrow waterways, the sub-vessels being subsequently reunited to re-establish said vessel.

8. A method according to claim 7, wherein the sub-vessels are reunited by pulling them together by means of wires and associated drawing equipment arranged on these sub-vessels.

9. A method according to claim 1, wherein the drilling barge is disconnected from the larger vessel and used separately at said second drilling site, when the height or depth of the water body does not exceed a predetermined low value.

10. A method according to claim 1, wherein the space on deck of the larger vessel not occupied by the drilling barge is used for a purpose selected from the group consisting of personnel accommodation, storage, and workshop.

11. A drilling vessel comprising a drilling barge having a part carrying a derrick and associated drilling equipment;

a larger supporting floatable vessel having an upper deck that is configured to receive the drilling barge in a position in which the drilling barge part carrying the derrick extends beyond the deck of the supporting vessel, means being provided for interconnecting the drilling barge and the supporting vessel in said position;

means for anchoring the barge in relation to a seabed by submerging the supporting vessel so as to position said vessel in contact with the seabed; and supporting spacing means arranged between the drilling barge and the supporting vessel, so as to position the drilling barge and the drilling equipment thereon in a desired position in relation to the seabed.

12. A drilling vessel according to claim 11, wherein the larger vessel comprises towing means for towing the drilling barge into position on the deck of the larger vessel.

13. A drilling vessel according to claim 11, wherein the spacing means comprise hydraulic rams or jacks for adjusting the height of the drilling barge and of the derrick positioned thereon.

14. A drilling vessel according to claim 11, further comprising a crane positioned on the deck of the supporting vessel, for use in preparing the drilling site.

15. A drilling vessel according to claim 11, wherein the supporting vessel is divided longitudinally into two separate sub-vessels, so as to allow transportation of the vessel on rivers and other narrow waterways.

16. A drilling vessel according to claim 15, wherein the sub-vessels comprise wire pulling means for pulling the sub-vessels together so as reunite the sub-vessels and form a combined supporting vessel.

17. A drilling vessel according to claim 11, wherein part of the deck of the supporting vessel not occupied by the drilling barge is configured for a use selected from the group consisting of personnel accommodation, storage, and workshop.

18. A method of establishing and/or operating a bore well in a bed or floor under a body of water at a selected location of operation by means of a drilling barge or vessel having a derrick or rig and associated drilling equipment, said method comprising the steps of:

providing a plurality of separate, floatable sub-vessels at a first location remote to the selected location of operation, the size and dimensions of each sub-vessel allowing for transportation of the sub-vessels on rivers or other narrow waterways;

towing the sub-vessels from the remote first location via such narrow waterway to a second location adjacent to or closer to the selected location of operation;

interconnecting the sub-vessels at said second location so as to form a barge;

mounting the derrick or rig and associated drilling equipment on the barge thus formed;

moving the drilling barge to the selected location of operation; and anchoring the drilling barge in relation to the bed or floor under said body of water so as to substantially align the derrick with the existing or planned bore well.

19. A method according to claim 18, wherein the sub-vessels being interconnected comprise a number of elongated first sub-vessels arranged in side-by-side relationship and extending in the longitudinal direction of the barge.

20. A method according to claim 19, wherein the sub-vessels being interconnected further comprise a pair of second sub-vessels being arranged fore and aft, respectively, at the ends of the first sub-vessels so as to extend transversely to the first sub-vessels.

21. A method according to claim 18, wherein the sub-vessels are drawn together and temporarily interconnected by mechanical interlocking means, the sub-vessels subsequently being interconnected more permanently, for example by welding.

22. A method according to claim 21, wherein adjacent, temporarily interconnected sub-vessels define a space therebetween, the sub-vessels being interconnected in such mutual position by welding the adjacent sub-vessels together within said space.

23. A method according to claim 22, wherein the adjacent sub-vessels are welded together at one or more levels above the water level.

24. A method according to claim 22, wherein the adjacent sub-vessels comprise outwardly extending spacing means bridging said space between the sub-vessels, the sub-vessels being welded together by welding said spacing means.

25. A method according to claim 18, wherein said anchoring step comprises the step of submerging the drilling barge so as to position its bottom in contact with said bed or floor.

26. A method according to claim 25, wherein each sub-vessel defines one or more water tanks therein, the barge being submerged by pumping water into at least some of said tanks.

27. A method according to claim 18, wherein the rig is of the land based type.

28. A method according to claim 18, wherein the rig or derrick is mounted on the barge by arranging a smaller barge comprising such rig or derrick and associated drilling equipment on the deck of the larger barge.

29. A method according to claim 21, wherein the more permanent interconnections are separated after completion of the operations of the barge so as to divide the barge into said sub-vessels.

30. A set of separately floatable sub-vessels for forming a drilling barge or vessel, said set comprising: a plurality of elongated first sub-vessels adapted to be arranged in side-by-side relationship so as to extend in the longitudinal direction of the vessel, the size and dimensions of each sub-vessel allowing for transportation of the sub-vessels on rivers or other narrow waterways, said sub-vessels having tanks formed therein, and each sub-vessel having connecting means for interconnecting the sub-vessels in a floating condition and comprising drawing equipment for drawing the sub-vessels into mutual adjacent positions;

mechanical interlocking means for temporarily interconnecting the sub-vessels in such position, and means for subsequently interconnecting the sub-vessels more permanently, each sub-vessel defining a deck part and a bottom part forming in the interconnected condition of the sub-vessels the deck and the bottom, respectively, of the vessel; and a drilling rig or derrick to be mounted on the deck of the vessel.

31. A set according to claim 30, wherein the means for more permanently interconnecting adjacent sub-vessels comprise weldable interconnecting flanges keeping adjacent sub-vessels mutually spaced in their interconnected condition.

32. A set according to claim 30, further comprising means for anchoring the assembled vessel in relation to the bed or floor under a body of water.

33. A set according to claim 32, wherein said anchoring means comprise means for submerging the vessel so as to position the bottom surface of the vessel in contact with the bed or floor.

34. A set according to claim 33, wherein the submerging means comprise pumping means for pumping water into the water tanks of the sub-vessels.

35. A set according to claim 30, wherein the bottom parts of the sub-vessels define a flat bottom of the vessel in their assembled condition.

36. A set according to claim 30, wherein the sub-vessels to be interconnected further comprise a pair of second sub-vessels to be arranged fore and aft at the ends of the first sub-vessels so as to extend transversely to the first sub-vessels.

37. A set according to claim 30, wherein the sub-vessels adapted to be arranged fore, aft and at the sides of the assembled vessel define sloped outer side surfaces being able to withstand ice forces.

38. A set according to claim 30, wherein the rig or derrick is positioned at the aft part of the assembled vessel above and in alignment with a through opening defined in the vessel.

39. A set according to claim 30, further comprising a smaller drilling barge to be arranged on top of the larger vessel formed by the sub-vessels, the rig or derrick being mounted on the smaller drilling barge.

40. A set according to claim 30, further comprising accessories necessary for performing drilling operations and/or production of petroleum products.

* * * * *